US006435924B2

(12) United States Patent
Ishino

(10) Patent No.: US 6,435,924 B2
(45) Date of Patent: Aug. 20, 2002

(54) AIR INDUCTION SYSTEM FOR SMALL WATERCRAFT

(75) Inventor: Tetsuya Ishino, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/734,954

(22) Filed: Dec. 11, 2000

(30) Foreign Application Priority Data

Dec. 9, 1999 (JP) ..... 11-349683

(51) Int. Cl.[7] ..... B63H 21/10
(52) U.S. Cl. ..... 440/88; 114/55.51
(58) Field of Search ..... 440/88, 89; 114/55.5, 114/55.51, 55.57, 56.1, 211

(56) References Cited

U.S. PATENT DOCUMENTS

| | | | | | |
|---|---|---|---|---|---|
| 4,084,531 | A | * | 4/1978 | Fujiura et al. | 114/211 |
| 4,568,293 | A | * | 2/1986 | Yazaki | 114/211 |
| 4,635,582 | A | * | 1/1987 | Nishida | 440/88 |
| 4,678,442 | A | * | 7/1987 | Nishida et al. | 114/55.51 |
| 4,689,028 | A | * | 8/1987 | Murase | 440/88 |
| 4,982,682 | A | | 1/1991 | Hattori | 440/89 |
| 4,984,528 | A | * | 1/1991 | Kobayashi | 114/211 |
| 4,991,532 | A | | 2/1991 | Locke | 440/88 |
| 5,136,547 | A | | 8/1992 | Laukien | 114/325 |
| 5,234,364 | A | | 8/1993 | Ito | 440/89 |
| 5,330,374 | A | | 7/1994 | Ishino | 440/42 |
| 5,340,344 | A | | 8/1994 | Mineo et al. | 440/88 |
| 5,389,022 | A | | 2/1995 | Kobayashi | 440/89 |
| 5,390,621 | A | | 2/1995 | Hattori et al. | 114/56.1 |
| RE34,922 | E | | 5/1995 | Hattori et al. | 114/56.1 |
| 5,537,948 | A | * | 7/1996 | Kobayashi | 440/88 |
| 5,562,509 | A | * | 10/1996 | Nakase et al. | 114/55.51 |
| 5,586,922 | A | | 12/1996 | Kobayashi et al. | 440/88 |
| 5,619,950 | A | | 4/1997 | Ikeda | 440/89 |
| 5,636,586 | A | | 6/1997 | Suganuma | 114/55.5 |
| 5,647,779 | A | | 7/1997 | Nanami | 440/38 |
| 5,664,515 | A | | 9/1997 | Hattori et al. | 440/88 |
| 5,699,749 | A | | 12/1997 | Yamada et al. | 440/89 |
| 5,735,229 | A | | 4/1998 | House et al. | 440/88 |
| 5,743,206 | A | | 4/1998 | Hattori | 440/89 |
| 5,752,867 | A | | 5/1998 | Koyanagi | 440/89 |
| 5,846,102 | A | | 12/1998 | Nitta et al. | 440/88 |
| 5,881,664 | A | | 3/1999 | Suganuma | 114/55.5 |
| 5,908,337 | A | | 6/1999 | Mashiko | 440/88 |
| 5,951,343 | A | | 9/1999 | Nanami et al. | 440/88 |
| 5,954,553 | A | * | 9/1999 | Ozawa et al. | 114/55.51 |
| 5,954,555 | A | | 9/1999 | Ozawa et al. | 440/89 |
| 5,957,072 | A | | 9/1999 | Hattori | 114/55.57 |
| 6,015,321 | A | | 1/2000 | Ozawa et al. | 440/88 |
| 6,022,253 | A | | 2/2000 | Ozawa et al. | 440/89 |
| 6,089,932 | A | | 7/2000 | Nanami et al. | 440/88 |
| 6,112,685 | A | | 9/2000 | Matsuda et al. | 114/55.53 |

FOREIGN PATENT DOCUMENTS

| | | |
|---|---|---|
| JP | 7-332183 | 12/1995 |
| JP | 8-104286 | 4/1996 |
| JP | 8-104295 | 4/1996 |
| JP | 9-301271 | 11/1997 |

OTHER PUBLICATIONS

Surface Vehicle Recommended Practice: Personal Watercraft—Flotation, SAE International, Apr. 4, 1991.
33 C.F.R. § 183.630: Standards for Natural Ventilation.

* cited by examiner

*Primary Examiner*—S. Joseph Morano
*Assistant Examiner*—Lars A. Olson
(74) *Attorney, Agent, or Firm*—Knobbe, Martens, Olson & Bear, LLP

(57) ABSTRACT

An induction system for a watercraft is configured to guide air into an engine disposed within the watercraft for combustion therein. The induction system includes an inlet assembly. The inlet assembly includes various constructions for enhancing water preclusive effects.

25 Claims, 5 Drawing Sheets

AIR INDUCTION SYSTEM FOR SMALL WATERCRAFT

PRIORITY INFORMATION

This application is based on and claims priority to Japanese Patent Application No. 11-349683, filed Dec. 9, 1999, the entire contents of which is hereby expressly incorporated by reference.

BACKGROUND OF THE INVENTION

1. Field of the Invention

The present invention is directed to a watercraft, and more particularly to a water preclusion and sound attenuation system employed in an induction system for a watercraft engine.

2. Description of Related Art

Personal watercraft have become increasingly popular in recent years. This type of watercraft is sporting in nature; it turns swiftly, it is easily maneuverable, and accelerates quickly. A personal watercraft today commonly carries one rider and up to three passengers. Typically, the rider and passengers sit on a straddle-type seat that is formed by the hull of the watercraft. The straddle-type seat is generally aligned with the longitudinal axis of the hull. The space beneath the straddle-type seat is usually used as an engine compartment for supporting the engine within the watercraft. The engine is preferably arranged within the engine compartment so that the crankshaft of the engine is aligned with the longitudinal axis of the watercraft. With the engine arranged as such, the crankshaft of the engine may be directly connected to an output shaft for driving a propulsion unit. Additionally, such an arrangement allows the engine to be arranged within the seat pedestal. Arranged as such, the engine and seat pedestal form a compact unit. During operation, the engine and any passengers straddle the seat as well as the engine while they are seated on the straddle-type seat. With the hull shaped as such, the engine is in close spacing with the passengers during operation, thus allowing the overall size of the watercraft to remain quite small, resulting in a compact and highly maneuverable watercraft.

One problem caused by the speed and maneuverability of these watercraft is that waterspray generated by the contact of the hull with the body of water in which the watercraft is operating causes water to spray upwardly onto the upper deck portion of the watercraft. Such waterspray increases the flow of water into the ventilation openings usually disposed on the upper deck of these watercraft. Such a flow of water into the ventilation openings can cause several problems. For example, a significant flow of water droplets into the ventilation openings can accumulate and eventually puddle in the bottom of the engine compartment within the watercraft. As the watercraft maneuvers, such puddled water sloshes within the engine compartment and may enter various components of the engine, such as, but without limitation, the induction system. Additionally, water which sloshes and comes into contact with hot engine components, can vaporize and flow into the induction system and the combustion chambers within the engine. Thus, it is desirable to construct an induction system which reduces the amount of water vapors introduced into the combustion chambers of the engine.

Another difficulty faced by owners of personal watercraft is that, at least partially in response to the noise generated by personal watercraft, certain recreational facilities have banned the operation of most personal watercraft.

SUMMARY OF THE INVENTION

According to one aspect of the present invention, a watercraft comprises a hull having a lower portion and an upper deck portion, an engine disposed within the hull which includes at least one combustion chamber and a body occupying a substantial volume of space within the engine compartment and is spaced from the engine. The watercraft also includes an induction system configured to guide air into the combustion chamber of the engine for combustion therein. The inlet to the induction system opens into the engine compartment and is disposed over the body.

By arranging the inlet to the induction system over the body, the watercraft according to the present invention reduces the likelihood that water present within the engine compartment can splash into the inlet of the induction system. Thus, the likelihood that the engine is damaged from water within the engine compartment is also reduced.

According to another aspect of the present invention, a watercraft includes a hull having a lower portion and an upper deck portion and an engine compartment defined within the hull. An engine is disposed within the engine compartment and includes at least one combustion chamber therein. The watercraft also includes an induction system configured to guide air into the combustion chamber for combustion therein. The induction system includes an inlet opening into the engine compartment. A splash guard is positioned adjacent the inlet and configured to prevent water within the engine compartment from splashing into the inlet. Preferably, the splash guard extends beneath the inlet so as to reduce the amount of water from the lower surface of the engine compartment that may splash into the inlet.

According to yet another aspect of the present invention, a watercraft includes a hull having a lower portion and an upper deck portion and an engine compartment defined within the hull. An engine is disposed within the engine compartment and includes at least one combustion chamber having an intake port. An induction system is configured to guide air into the combustion chamber for combustion therein and includes a vapor separator disposed within the hull so as to be not directly above the engine.

Another aspect of the present invention includes the realization that performance of a vapor separator within the engine compartment of a watercraft can be improved if the vapor separator is not positioned directly above the engine. For example, as a vapor separator operates, to reduce an amount of water vapor within an air supply, heat added or conducted into the vapor separator raises the vapor pressure of the water therein, thus reducing the effectiveness of the vapor separator to remove water from an airflow passing therethrough. Heat from the engine can be conducted into the vapor separator by radiation and/or convection. Thus, by positioning the vapor separator so as not to be directly over the engine, heat conducted into the vapor separator from the engine is thereby attenuated, thus improving the performance of the vapor separator. Thus, more water vapor is separated from air entering the induction system thereby further protecting the engine and improving combustion conditions within the combustion chamber.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF THE PREFERRED EMBODIMENTS OF THE INVENTION

Figure 1:
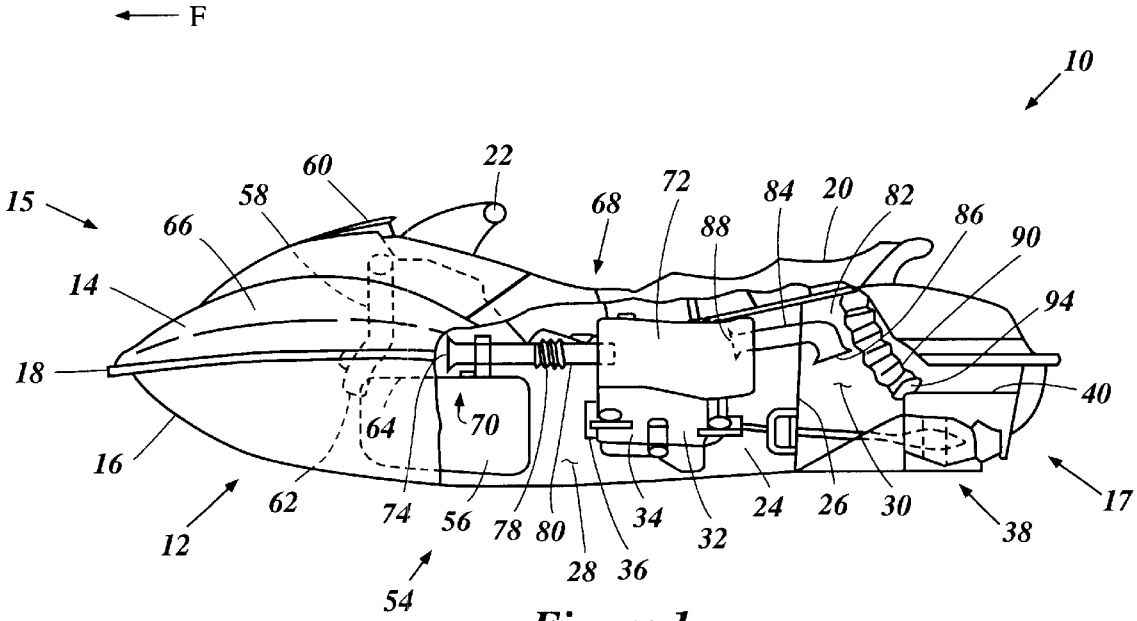
FIG. 1 is a side elevational and partial cut-away view of a watercraft in accordance with a preferred embodiment of the present invention. The illustrated watercraft includes a lower portion and an upper deck portion and several internal components of the watercraft are shown in phantom line.
Figure 2:
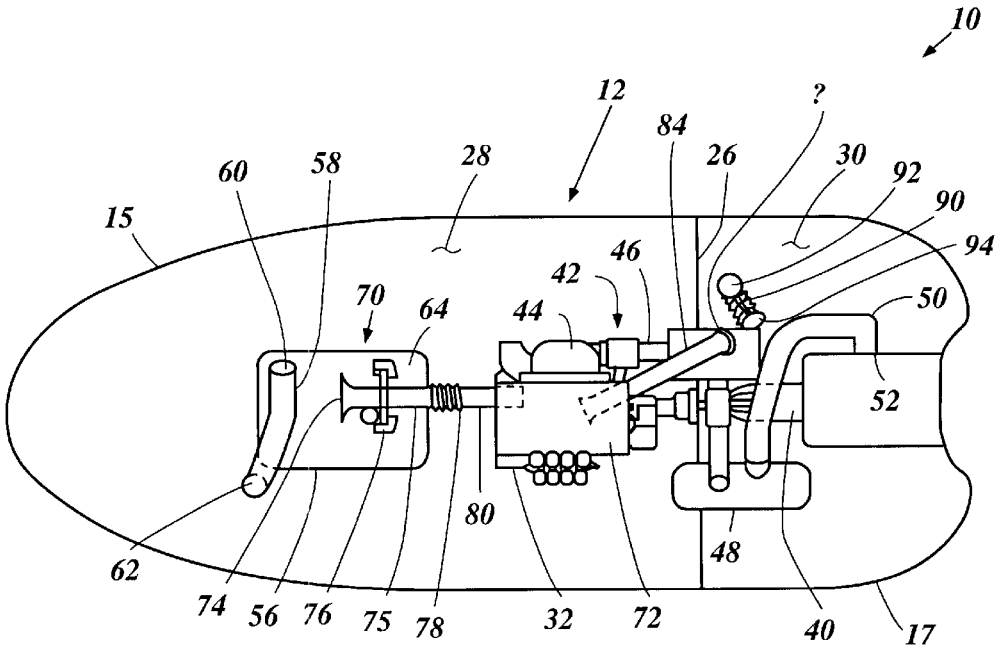
FIG. 2 is a top plan view of the watercraft illustrated in FIG. 1 with the upper deck portion removed.

FIGS. 1 and 2 illustrate different views of a small watercraft incorporating an induction system configured in accordance with a preferred embodiment of the present invention. The induction system includes enhanced water preclusion characteristics. Although the present induction system is illustrated in connection with a personal watercraft, the illustrated induction system can be used with any type of watercraft as well, such as, for example, but without limitation, small jet boats and the like.

FIGS. 1 and 2 illustrate a watercraft 10 having a hull 12 which is constructed of a top deck portion 14 and a lower portion 16 defining a bow 15 and a stern 17 of the watercraft 10. A gunnel 18 defines an intersection of the lower portion 16 and the deck 14 of the hull 12. The watercraft 10 is suited for movement through a body of water in a direction F (towards the front end of the watercraft).

A seat 20 is positioned on a seat pedestal (not shown which is formed by the deck 14. A steering handle 22 is provided adjacent the seat 20 for use by a user in directing the watercraft 10. Preferably, a bulwark (not shown) is defined by the gunnel 18 and extends upwardly along each side of the watercraft 10. A foot step area is preferably defined between the seat 20 and the bulwark on each side of the watercraft 10.

The upper and lower portions 14, 16 define an interior volume 24 within the hull 12. In the illustrated embodiment, a bulkhead 26 divides the inner volume 24 into a forward compartment 28 and a rearward compartment 30. In the illustrated embodiment, the forward compartment 28 defines an engine compartment.

An engine 32 is positioned in the engine compartment 28. The engine 32 is connected to the lower portion 16 with several engine mounts (not shown) which are shaped to be bolted to the lower portion 16 of the hull or an insert (not shown) which is attached to the lower hull portion 16.

The engine 32 is preferably at least partially accessible through a maintenance opening (not shown) which itself is accessible by removing the seat 20. The engine 32 includes a crankshaft (not shown) which is located at least partially within a crankcase 34, and which is connected to a flywheel (not shown) in a known manner. The engine 32 includes a flywheel cover 36 arranged at a forward end of the crankcase 34 of the engine 32.

The engine 32 transfers rotational energy from the rotational crankshaft to a propulsion unit 38 provided in the rearward compartment 30. The propulsion unit 38 is provided in a tunnel 40 formed in the lower portion 16 of the hull 12. Arranged as such, the propulsion unit 38 induces a flow of water into an inlet of the tunnel 40 and out through a rear outlet of the tunnel 40 to thereby propel the watercraft in a known manner.

The engine 32 preferably includes a plurality of cylinders arranged along the longitudinal axis and operates on a four-stroke principle. Of course, the engine 32 may have any number of cylinders arranged in different cylinder orientations and may operate in accordance with other combustion principles (e.g., two-cycle, diesel, and rotary principles). The engine 32 includes a cylinder head mounted to a cylinder block and cooperates therewith to define a plurality of cylinders. A piston (not shown) is movably mounted in each cylinder and is connected to the crankshaft via a connecting rod, in a well known manner. The piston cooperates with the cylinder head and the cylinder block so as to define a combustion chamber portion corresponding to each cylinder.

The engine 32 includes at least one intake port for each combustion chamber defined therein. In the illustrated embodiment, the intake ports are defined in the cylinder head, the flow therethrough being controlled by an intake valve and an intake valve drive train (not shown).

In order to process exhaust gases discharged from the engine 32, the watercraft 10 includes an exhaust system 42. As shown in FIG. 2, the exhaust system 42 includes an exhaust manifold 44 which is connected to a plurality of exhaust ports defined in the cylinder head of the engine 32. An outlet of the exhaust manifold 44 communicates with an exhaust pipe 46 extending rearwardly, through the bulkhead 26, and to an inlet of a watertrap device 48. A discharge exhaust pipe 50 extends from an outlet of the water trap device 46 to an exhaust discharge port 52 disposed on a side of the hull tunnel 40.

The watercraft 10 also includes a fuel delivery system 54. The fuel delivery system 54 includes a fuel tank 56 and at least one charge former (not shown). Fuel from the fuel tank 56 is supplied to the charge formers via at least one fuel delivery line (not shown). The configuration of the fuel delivery system 54 is constructed in accordance with the type of fuel chargers provided in the engine 32. For example, watercraft 10 can include a fuel delivery system configured for delivering fuel to carburetors which serve as charge formers for the engine 32 or fuel injectors configured to perform direct or indirect fuel injection.

With reference to FIGS. 1 and 2, the watercraft 10 also includes at least one ventilation air duct 58, which allows air from the atmosphere surrounding the watercraft 10 to enter the engine compartment 28. As shown in FIG. 1, the ventilation air duct 50 includes an inlet end 60 which is exposed to ambient air surrounding the watercraft 10 and a second end 62 which opens into the engine compartment 28. In the illustrated embodiment, the outlet 62 of the duct 58 is arranged so as to be positioned below an upper surface 64 of the fuel tank 56. A hatch assembly 66 extends over the first end 60 of the ventilation duct 58.

The watercraft 10 also includes an induction system 68 which is configured to guide air into the combustion chambers defined within the engine 32. The induction system 68 includes an inlet assembly 70 and a first plenum chamber 72. In the illustrated embodiment, the inlet assembly 70 includes a trumpet-shaped inlet 74 disposed over the upper surface 64 of the fuel tank 56.

As shown in FIG. 2, the inlet assembly 70 is supported on the upper surface 54 of the fuel tank by a bracket assembly 76. The inlet assembly 70 is connected to a flexible coupling 78 which, in turn, is connected to a second intake pipe 80. The intake pipe 80 extends into an interior of the plenum chamber 72.

The plenum chamber 72 can be constructed in any known manner. Preferably, the plenum chamber 72 is connected to at least one throttle body which is configured to control an air flow from an interior of the plenum chamber 72 into the combustion chambers within the engine 32. Where carburetors are used as the charge formers for the engine 32, the throttle valves can be incorporated into the carburetors.

By arranging the inlet 74 of the inlet assembly 70 over the fuel tank 56, the induction system 68 of the present invention allows the induction system to draw air from a position within the engine compartment 28 which is distal from the engine 32. Thus, the air entering the inlet 74 is not likely to have been heated significantly by the engine 32.

Additionally, by connecting the first inlet pipe 75 to the second inlet pipe 80 with a flexible connector 78, installation of the inlet assembly 70 is made easier. For example, during the assembly of the watercraft 10, the engine 32 and the fuel tank 56 are installed into the engine compartment 28 separately from each other. Thus, when the first inlet pipe 75 is connected to the second inlet pipe, the alignment of the first inlet pipe 75 and the second inlet pipe 80 can be adjusted by the flexation of the flexible connector 78 thus allowing compensation for alignment differences between the bracket 76 and the second inlet pipe 80.

With reference to FIG. 1, the induction system 68 preferably also includes a second inlet assembly 82. As shown in FIG. 1, the second inlet assembly 82 includes a third inlet pipe 84 defining an inlet 86 at a first end of the third intake pipe 84 and second end 88 opening into the interior of the plenum chamber 72. The inlet 86 opens into the rearward compartment 30.

In order to guide air into and out of the rearward compartment 30, a second ventilation duct 90 extends into the rearward compartment 30. The ventilation duct 90 includes an upper end 92 communicating with the ambient air surrounding the watercraft 10. A second end 94 of the ventilation duct 90 opens into the rearward compartment 30. Thus air from the outside of the watercraft can enter the rearward compartment 30 via the ventilation duct 90. Subsequently, air from the compartment 30 can enter the inlet 86 and provide additional air to the interior of the plenum chamber 72.

With reference to FIGS. 2–6, modification of the inlet assembly 70 is shown therein. The other components of the watercraft 10, however, are constructed in accordance with the description of FIGS. 1 and 2. Thus, similar features are ascribed the same reference numerals used for corresponding elements from FIGS. 1 and 2 for ease of description.

Figure 3:
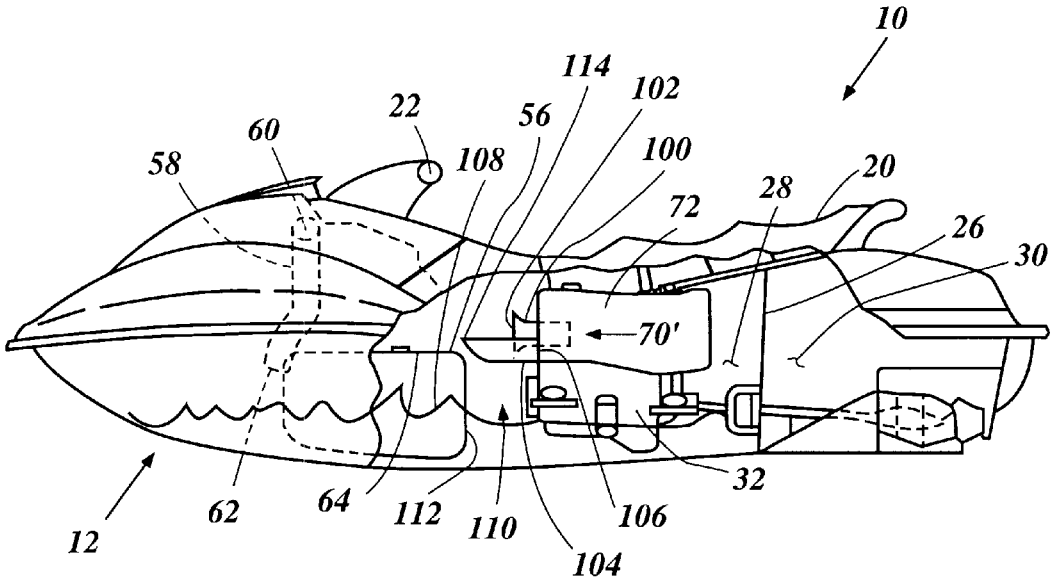
FIG. 3 is a side elevational view and partial cut-away view of a modification of the watercraft illustrated in FIG. 1 and illustrating an induction system inlet assembly.
Figure 4:
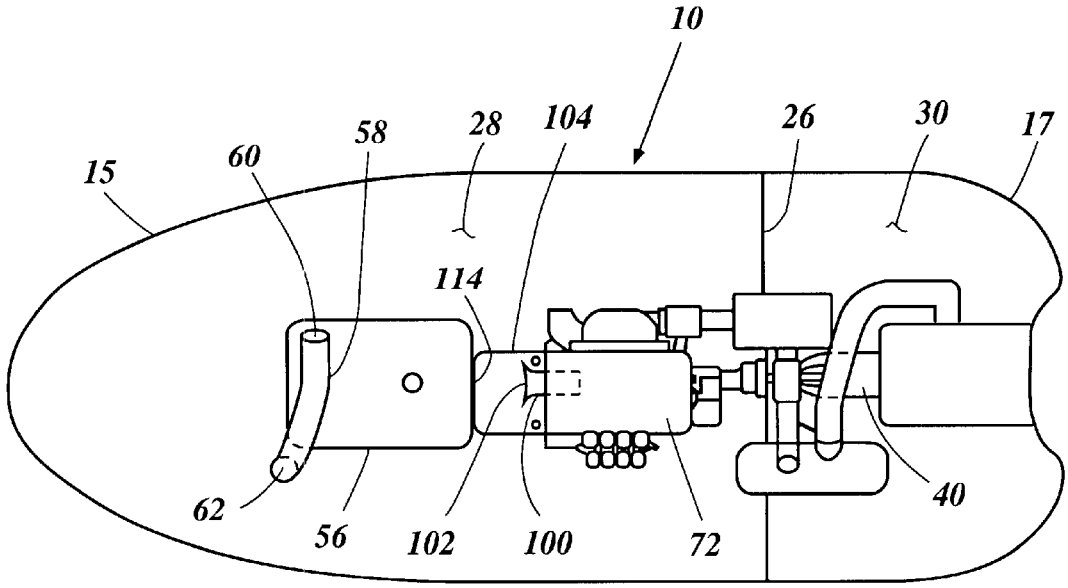
FIG. 4 is a top plan view of the watercraft illustrated in FIG. 3 with the upper deck portion removed.

With reference to FIGS. 3 and 4, the inlet assembly 70' includes a first intake pipe 100 extending from an interior of the plenum chamber 72. In the illustrated embodiment, the intake pipe 100 includes a trumpet-shaped inlet 102 facing forwardly and opening into the interior of the engine compartment 28. The inlet assembly 70' also includes a splash guard 104. The splash guard 104 extends from a surface 106 of the plenum chamber 72 adjacent to the inlet 102. Preferably, the splash guard 104 is bowl-shaped.

As shown in FIG. 3, during the operation of the watercraft 10, a significant amount of water 108 can enter the hull 12 in a number of ways. For example, during operation of the watercraft 10 in a body water, water can be sprayed into the air by the impact of the hull 12 with the surface of the body of water in which the watercraft 10 is operating. Such sprayed water can enter the intake duct 58 through the inlet 60 and collect in the engine compartment 28. Additionally, the watercraft 10 may be capsized during operation and water may flow directly through the ventilation duct 58 into the engine compartment 28. After capsizing or as a result of water spray entering the engine compartment 28 through the ventilation duct 50, water 108 collected in the engine compartment 28 can be violently splashed within the engine compartment 28 thus causing large droplets 110 to splash upwardly toward the inlet 102. Thus, the splash guard 104 is configured to prevent water from the engine compartment from splashing into the inlet 102.

In the illustrated embodiment, engine 32 and the fuel tank 56 are spaced from each other. The splash guard 104 extends from the surface 106 of the plenum chamber 72 to a position adjacent a surface 112 of the fuel tank 56. In the illustrated embodiment, the surface 106 of the plenum chamber 72 from which the intake pipe 100 extends is a forward surface of the plenum chamber and the surface 112 with the fuel tank 56 is a rear surface of the fuel tank. Thus, the flash guard 104 can be sized or arranged to cooperate with the surface 112 of the fuel tank 56 to provide a further shielding from splashes of water 110 within the engine compartment 120. In the illustrated embodiment, a forward edge 114 of the splash guard 104 and the rear surface 112 above the fuel tank 56 is substantially aligned along the vertical plane. As such, the splash guard 104 and the fuel tank 56, which occupies a substantial volume of space within the engine compartment 28, cooperate to prevent splashing water 110 from reaching the inlet 102. With reference to FIG. 3, forward edge 114 can be arranged so as to at least partially overlap the upper surface 64 of the fuel tank 56. As such, the splash guard 104 will provide a further shielding of the inlet 102 from splashing water 110 within the engine compartment 28.

Figure 5:
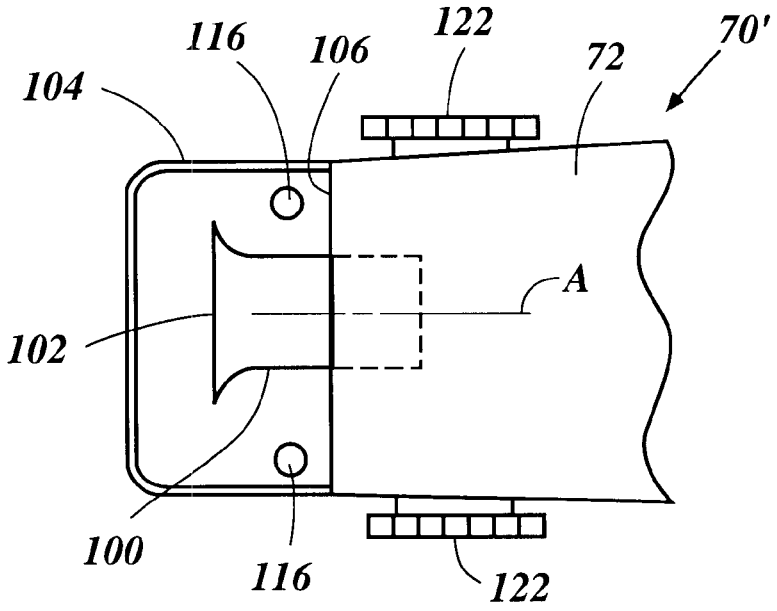
FIG. 5 is an enlarged top plan view of the induction system inlet assembly illustrated in FIGS. 3 and 4.

With reference to FIG. 5, the inlet assembly 70' preferably includes at least one drain 116 formed in the splash guard 104. In the illustrated embodiment, the splash guard 104 includes two drains, one on each side of the longitudinal axis A of the intake pipe 100. By including at least one drain 116 in the splash guard 104, water that does reach the upper side of the splash guard 104 is returned to the engine compartment 28, thereby reducing the amount of water that may splash into the inlet 102.

Figure 6:
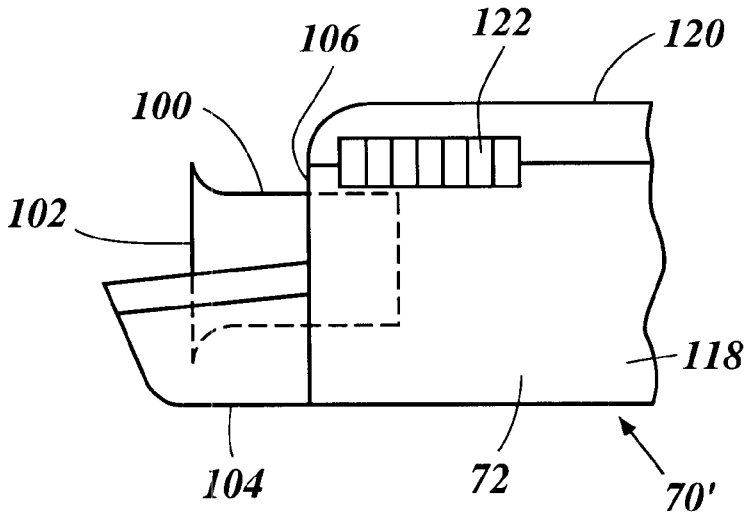
FIG. 6 is a side elevational view of the induction system inlet assembly illustrated in FIG. 5.

With reference to FIG. 6, the splash guard 104 is preferably fixed to the front surface 106 of the plenum chamber 72. Additionally, the plenum chamber 72 is preferably formed with a body member 118 and a removable cover 120. The removable cover 120 is locked to the body 118 with a slide lock mechanism 122.

Figure 7:
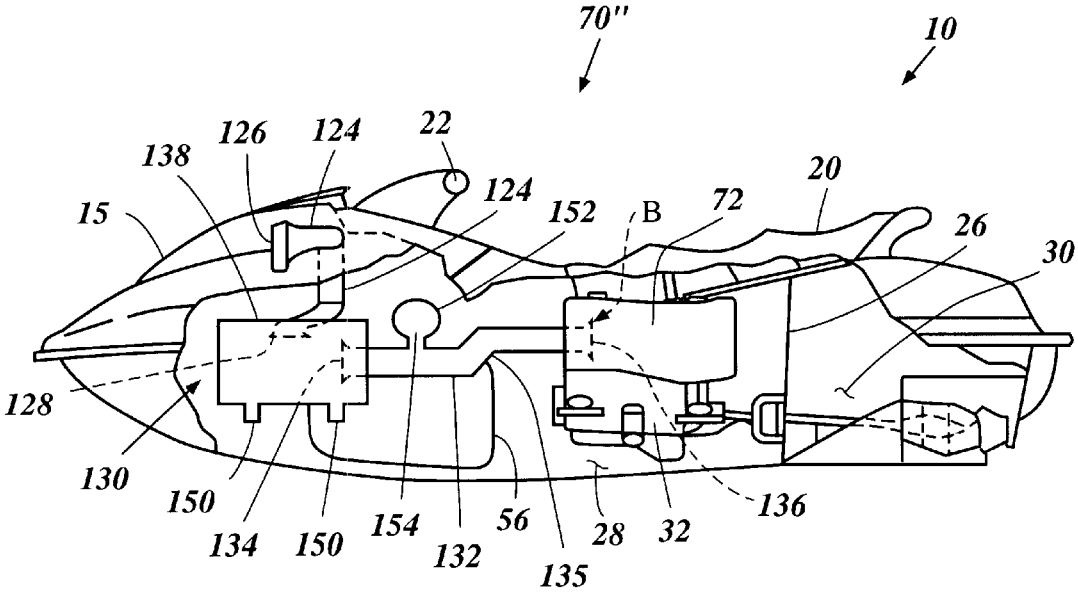
FIG. 7 is a side elevational and partial cut-away view of a watercraft constructed in accordance with a modification of the embodiment illustrated in FIGS. 1–4.
Figure 8:
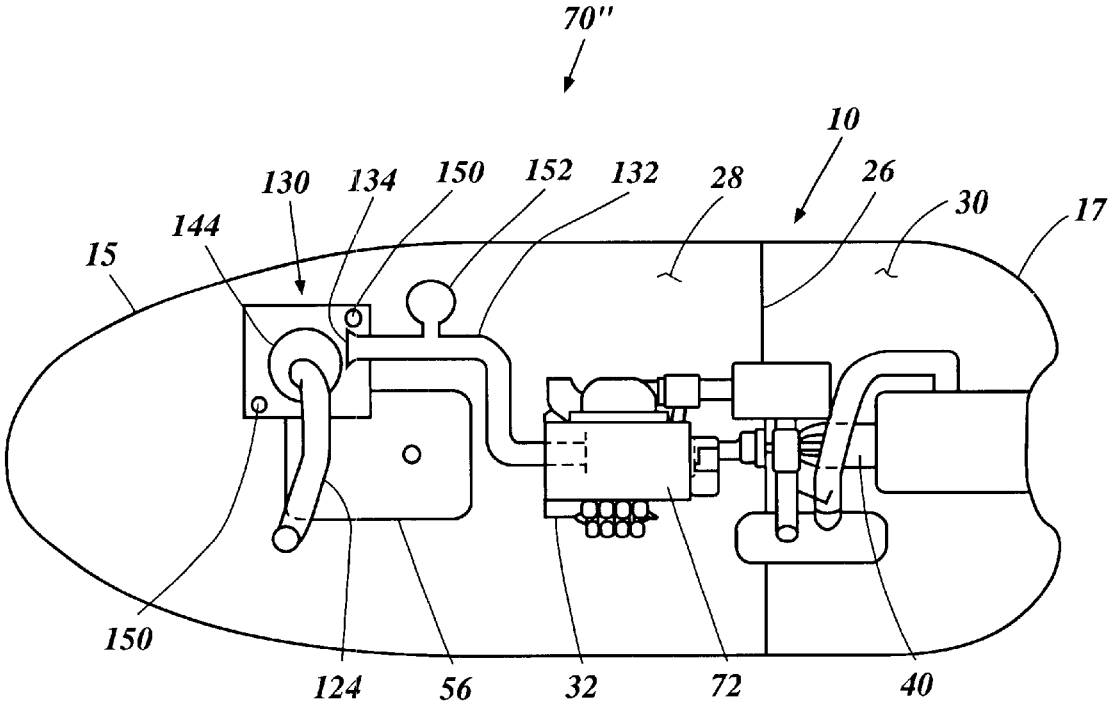
FIG. 8 is a top plan view of the modification illustrated in FIG. 7, with the upper deck portion removed.

With respect to FIGS. 7 and 8, a further modification to the inlet assemblies 70, 70', identified as reference numeral 70", is illustrated therein. The remaining features of the watercraft 10 illustrated in FIGS. 7 and 8 and constructed in accordance with the above descriptions of FIGS. 1–6. Similar features thus are ascribed the same reference numerals used for the corresponding elements from FIGS. 1–6 for ease of description.

The inlet 70" includes a first intake pipe 124 which has a forward facing inlet 126 and an outlet 128 disposed within the engine compartment 128. The outlet communicates with a vapor separator 130, a further detailed description of which is set forth below with reference to FIGS. 9 and 10. The vapor separator 130 is disposed such that it is not directly above the engine 32. Preferably, the vapor separator 130 is disposed partially forward from the fuel tank 56.

The inlet assembly 70" also includes a second intake pipe 132 having an inlet 134 communicating with the vapor separator 130 and an outlet 136 communicating with an interior of the vapor separator 72. Preferably, at least portion of the second intake pipe 132 is inclined such that the inlet 134 is lower than the outlet 136. In the illustrated embodiment, the second intake pipe 132 includes an inclined portion 135.

Figure 9:
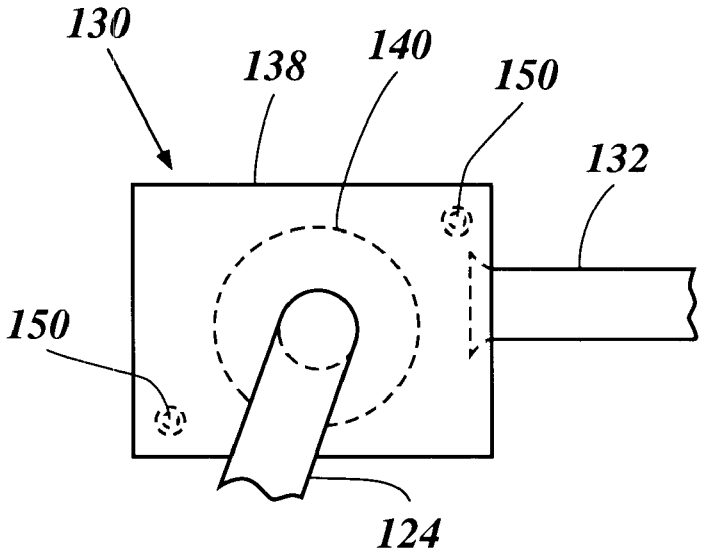
FIG. 9 is an enlarged top plan view of a vapor separator illustrated in FIG. 7.
Figure 10:
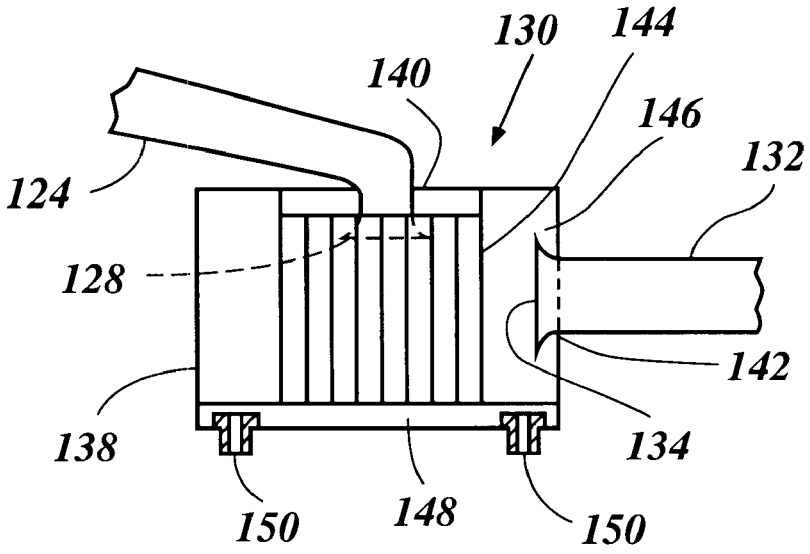
FIG. 10 is a side elevational view of the vapor separator illustrated in FIG. 9.

With reference to FIGS. 9 and 10, the vapor separator 130 includes an outer housing 138. The housing 138 includes an inlet 140 which cooperates with the outlet 128 of the first intake pipe 124. The housing 138 also includes an air outlet 142 which cooperates with the inlet 134 of the second intake pipe 132. A cylindrical water filter device 144 is disposed within the housing 138. The filter 144 is configured to allow air to pass therethrough and to substantially prevent water and water vapor from passing therethrough. Thus, the filter 144 cooperates with the housing to define an air chamber 146 and a water collection chamber 148.

The water collection chamber 148 includes at least one drain 150 and preferably a plurality of drains 150, configured to allow water collected therein to flow into the engine compartment 28 which can then be removed by any known bilge system.

During operation, air from the atmosphere surrounding watercraft 10 enters the inlet 126 of the first intake pipe 124. Such air, which is often times mixed with water and water vapor due to the movement of the watercraft 10 along the surface of a body of water, flows through the first intake pipe 124 and into the vapor separator 130. The filter 144 allows air to pass radially therethrough and thus into the air chamber 146. Additionally, the filter 144 prevents at least some of the water and water vapor contained in the air flow from passing therethrough and thus causes the water and water vapor to pass downwardly into the water collection chamber 148. Thus, the water content of the air entering the air chamber 146 is reduced relative to the water content of the air entering the inlet 126.

Air from the air chamber 146 then passes into the inlet 144 of the second intake pipe 132 and eventually into the plenum chamber 172. Water that is collected in the water collection chamber 148 is drained by at least one drain 150 and allowed to pass into the engine compartment 28 which then can be drained from the engine compartment 28 with a known bilge system.

With reference to FIGS. 7 and 8, the vapor separator 130 is arranged within the hull 112 so as not to be directly over the engine 132. Thus, the heat transferred from the engine 32 to the vapor separator 130 is reduced. By reducing the heat transfer to the vapor separator, the performance of the vapor separator can be enhanced. For example, raising the temperature of air which has some water content, also raises the vapor pressure of water within such air. Thus, by reducing the transfer of heat into the vapor separator 130, the effect of heat from the engine 32 on the performance of the vapor separator 130 is attenuated.

Referring to FIG. 7, the second intake pipe 132 preferably includes a subresonator chamber 152. The subresonator chamber 152 is branched from the second intake pipe 132 and communicates with the second intake pipe 132 through a throat 154. The subresonator chamber 152 is configured to attenuate noise generated in the reduction system 68 of the watercraft 10. Preferably, the subresonator chamber 152 is in the form of a Helmholtz resonator which is turned to attenuate noise generated in the induction system 68. As such, the subresonator chamber 152 provides attenuation of noise generated by the induction system 68 thereby quieting emitted from the watercraft 10 during operation.

As noted above, the inlet 134 is lower than the outlet 136. Thus, if water passes through the filter 144 and into the inlet 134, it is less likely that such water can migrate upward through the second intake pipe 132 and into the plenum chamber 72. Thus, by arranging the inlet 134 is lower than the outlet 136, the water preclusive character of the inlet assembly 70" is further enhanced.

Accordingly, although this invention has been described in terms of certain preferred embodiments, other embodiments apparent to those of ordinary skill in the art are also within the scope of this invention. Of course, the watercraft need not include all these features to appreciate some of the aforementioned advantages associated with the present watercraft. Accordingly, the scope of the invention is intended to be defined only by the claims that follow.

What is claimed is:

1. A watercraft comprising a hull having a lower portion and upper deck portion, an interior volume within the hull, an engine disposed within the interior volume, the engine including at least one combustion chamber therein, a body disposed within the interior volume and occupying a substantial volume of space within the interior volume, an induction system configured to guide air from the interior volume into the combustion chamber for combustion therein, the induction system including an inlet disposed over the body.

2. The watercraft according to claim 1, wherein the inlet is disposed directly over the body.

3. The watercraft according to claim 1, wherein the body is a fuel tank.

4. The watercraft according to claim 1, wherein the body is disposed forward from the engine.

5. The watercraft according to claim 1, wherein the inlet is disposed remotely from the engine.

6. The watercraft according to claim 1 additionally comprising a ventilation conduit having a first end communicating with atmospheric air surrounding an outside of the hull and a second end disposed within the hull, the inlet and the second end being disposed on a same side of the engine.

7. The watercraft according to claim 1, wherein the inlet is supported within the hull independently from the engine.

8. The watercraft according to claim 1, wherein the inlet is supported by the body.

9. A watercraft comprising a hull having a lower portion and upper deck portion, an engine compartment within the hull, an engine disposed within the engine compartment, the engine including at least one combustion chamber therein, a body disposed within the engine compartment and occupying a substantial volume of space within the engine compartment, an induction system configured to guide air into the combustion chamber for combustion therein, the induction system including an inlet disposed over the body, and a plenum chamber defining a portion of the induction system downstream from the inlet and a flexible conduit connecting the inlet with the plenum chamber.

10. A watercraft comprising a hull having a lower portion and upper deck portion, an engine compartment defined by the lower portion and the upper deck, an engine disposed within the engine compartment, the engine including at least one combustion chamber therein, an induction system configured to guide air into the combustion chamber for combustion therein, the induction system including an inlet opening into the engine compartment, and a splash guard positioned adjacent the inlet and configured to prevent water within the engine compartment from splashing into the inlet.

11. The watercraft according to claim 10 additionally comprising a fuel tank, the inlet being disposed above the fuel tank.

12. The watercraft according to claim 11 wherein the splash guard extends between the engine and the fuel tank.

13. A watercraft comprising a hull having a lower portion and upper deck portion, an engine compartment defined within the hull, an engine disposed within the engine compartment, the engine including at least one combustion chamber therein, an induction system configured to guide air into the combustion chamber for combustion therein, the induction system including an inlet opening into the engine compartment, and a splash guard positioned adjacent the inlet and configured to prevent water within the engine compartment from splashing into the inlet, wherein the splash guard extends from a surface of the engine body toward the fuel tank.

14. A watercraft comprising a hull having a lower portion and upper deck portion, an engine compartment defined within the hull, an engine disposed within the engine compartment, the engine including at least one combustion chamber therein, an induction system configured to guide air into the combustion chamber for combustion therein, the induction system including an inlet opening into the engine compartment, and a splash guard positioned adjacent the inlet and configured to prevent water within the engine compartment from splashing into the inlet, and a body occupying a substantial volume of space, the body being disposed in the engine compartment and spaced from the engine, the body including at least one surface, wherein the splash guard comprises a first edge extending outwardly from the inlet, the first edge and the surface of the body being substantially aligned along a vertical plane.

15. A watercraft comprising a hull having a lower portion and upper deck portion, an engine compartment defined within the hull, an engine disposed within the engine compartment, the engine including at least one combustion chamber therein, an induction system configured to guide air into the combustion chamber for combustion therein, the induction system including an inlet opening into the engine compartment, and a splash guard positioned adjacent the inlet and configured to prevent water within the engine compartment from splashing into the inlet, and a body disposed within the engine compartment, wherein an outer edge of the splash guard extends over the body.

16. The watercraft according to claim 15, wherein the body occupies a substantial volume of space within the engine compartment.

17. The watercraft according to claim 16, wherein the body is a fuel tank.

18. A watercraft comprising a hull having a lower portion and upper deck portion, an engine compartment defined within the hull, an engine disposed within the engine compartment, the engine including at least one combustion chamber and an intake port, an induction system configured to guide air into intake port for combustion in the combustion chamber, the induction system including a vapor separator disposed within the hull so as not to be directly above the engine, the induction system defining a substantially closed air flow path from the vapor separator to the intake port.

19. The watercraft according to claim 18 additionally comprising a plenum chamber communicating with the intake port, and a conduit connecting the vapor separator with the plenum chamber.

20. The watercraft according to claim 18, wherein the vapor separator is disposed remotely from the engine.

21. The watercraft according to claim 18 additionally comprising a forward facing inlet for guiding atmospheric air into the vapor separator.

22. The watercraft according to claim 18 additionally comprising a fuel tank, at least a portion of the vapor separator being disposed forward from the fuel tank.

23. The watercraft according to claim 18, wherein the vapor separator comprises a water filter.

24. The watercraft according to claim 23 additionally comprising a drainage chamber disposed beneath the water filter for collecting water filtered from air in the vapor separator.

25. The watercraft according to claim 24 additionally comprising a drain disposed in the drainage chamber.

* * * * *